United States Patent [19]

Carlisle

[11] 4,189,913

[45] Feb. 26, 1980

[54] REFLEX AIR BURNER WITH AIRBLAST START

[75] Inventor: Denis R. Carlisle, Risley, England

[73] Assignee: Rolls-Royce Limited, London, England

[21] Appl. No.: 875,932

[22] Filed: Feb. 7, 1978

[30] Foreign Application Priority Data

Feb. 11, 1977 [GB] United Kingdom ..... 5885/77

[51] Int. Cl.[2] ..... F02O 7/22; F02O 7/26

[52] U.S. Cl. ..... 60/39.14 R; 60/740; 60/726; 239/295

[58] Field of Search ..... 60/39.14 R, 39.71, 39.74 R, 60/39.74 B; 239/294, 295, 296, 297, 300

[56] References Cited

U.S. PATENT DOCUMENTS

| | | | |
|---|---|---|---|
| 2,959,003 | 11/1960 | Carlisle et al. | 60/39.74 B |
| 2,999,359 | 9/1961 | Murray | 60/39.74 R |
| 3,668,869 | 6/1972 | DeCorso et al. | 60/39.74 R |
| 3,763,650 | 10/1973 | Hussey et al. | 60/39.74 B |
| 3,866,413 | 2/1975 | Sturgess | 60/39.74 R |

*Primary Examiner*—Louis J. Casaregola

*Attorney, Agent, or Firm*—Cushman, Darby & Cushman

[57] ABSTRACT

In a gas turbine engine, fuel and air is forced into the primary zone of the engine combustion chambers during the start-up sequence by means of compressed air which is ducted through the engine fuel burners and impinges on fuel issuing from the burners, forcing the fuel to flow through tubes into the combustion chamber primary zone.

5 Claims, 2 Drawing Figures

50
52
64
64
60
58
56
62

REFLEX AIR BURNER WITH AIRBLAST START

This invention relates to combustion equipment, more particularly for gas turbine engines and is concerned with ensuring that sufficient fuel and air mixture reaches the primary zone of the combustion chamber of such equipment when required.

The present invention provides combustion equipment suitable for a gas turbine engine, the equipment comprising a fuel burner and a combustion chamber, the fuel burner comprising a fuel nozzle having a number of fuel outlets arranged to direct fuel into a first duct in the combustion chamber and fuel directing means arranged to direct fuel from at least some of the said fuel outlets into a corresponding number of second ducts extending from said first duct to communicate a fuel and air mixture into the primary zone of the said combustion chamber.

The fuel directing means may comprise a supply of compressed air in communication with a number of air outlets in the fuel nozzle, the air outlets being aligned with corresponding fuel outlets and directed so that compressed air may impinge upon the fuel issuing from the fuel outlets and direct the fuel into the second ducts.

The supply of compressed air may be contained in a high pressure container which may be rechargeable from the compressor of the gas turbine engine of which the combustion equipment forms part.

The supply of compressed air may be controlled so that compressed air is only supplied during the start-up sequence of the gas turbine engine and is closed off when the engine has reached a predetermined rotational speed.

Figure 1:
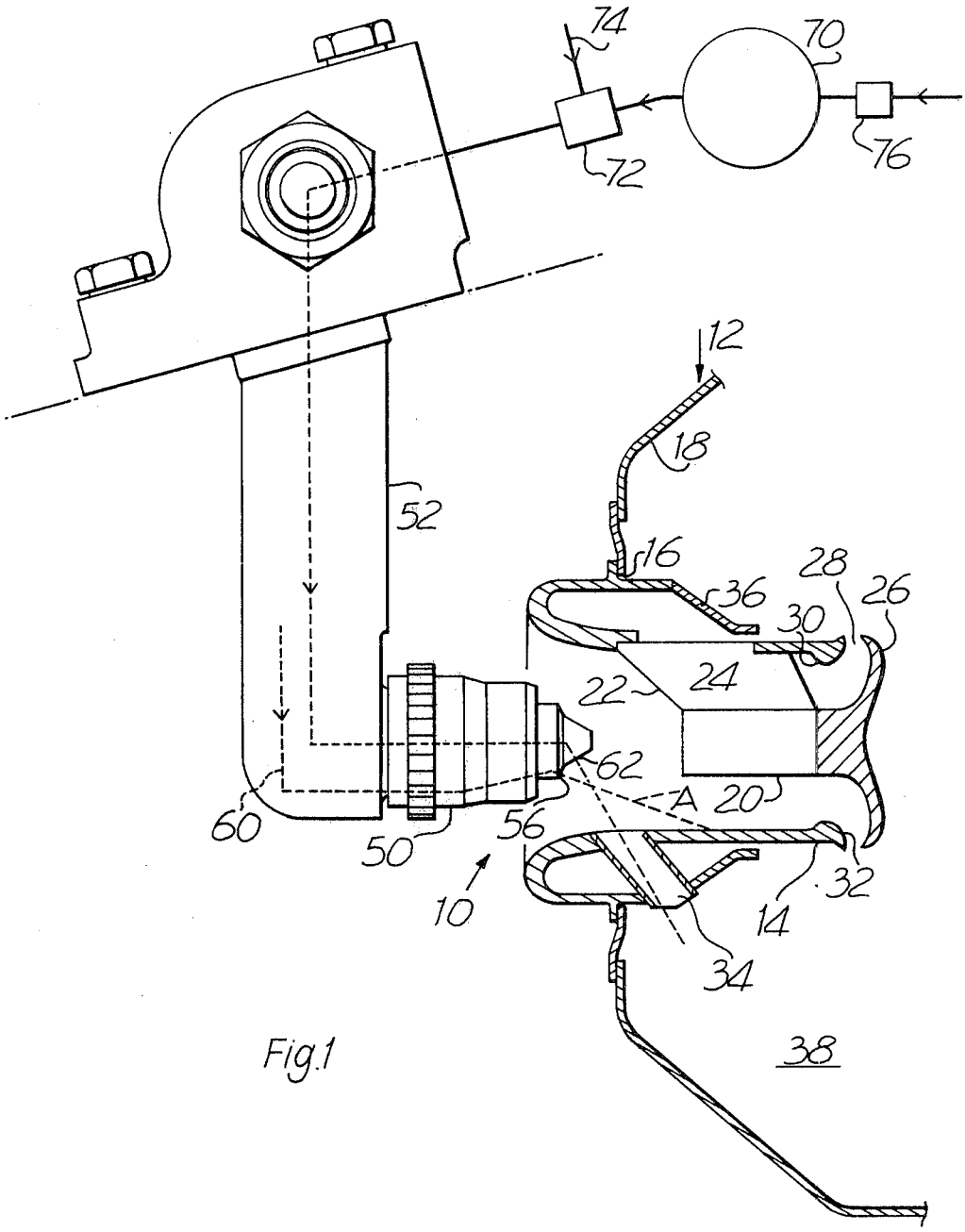
Figure 2:
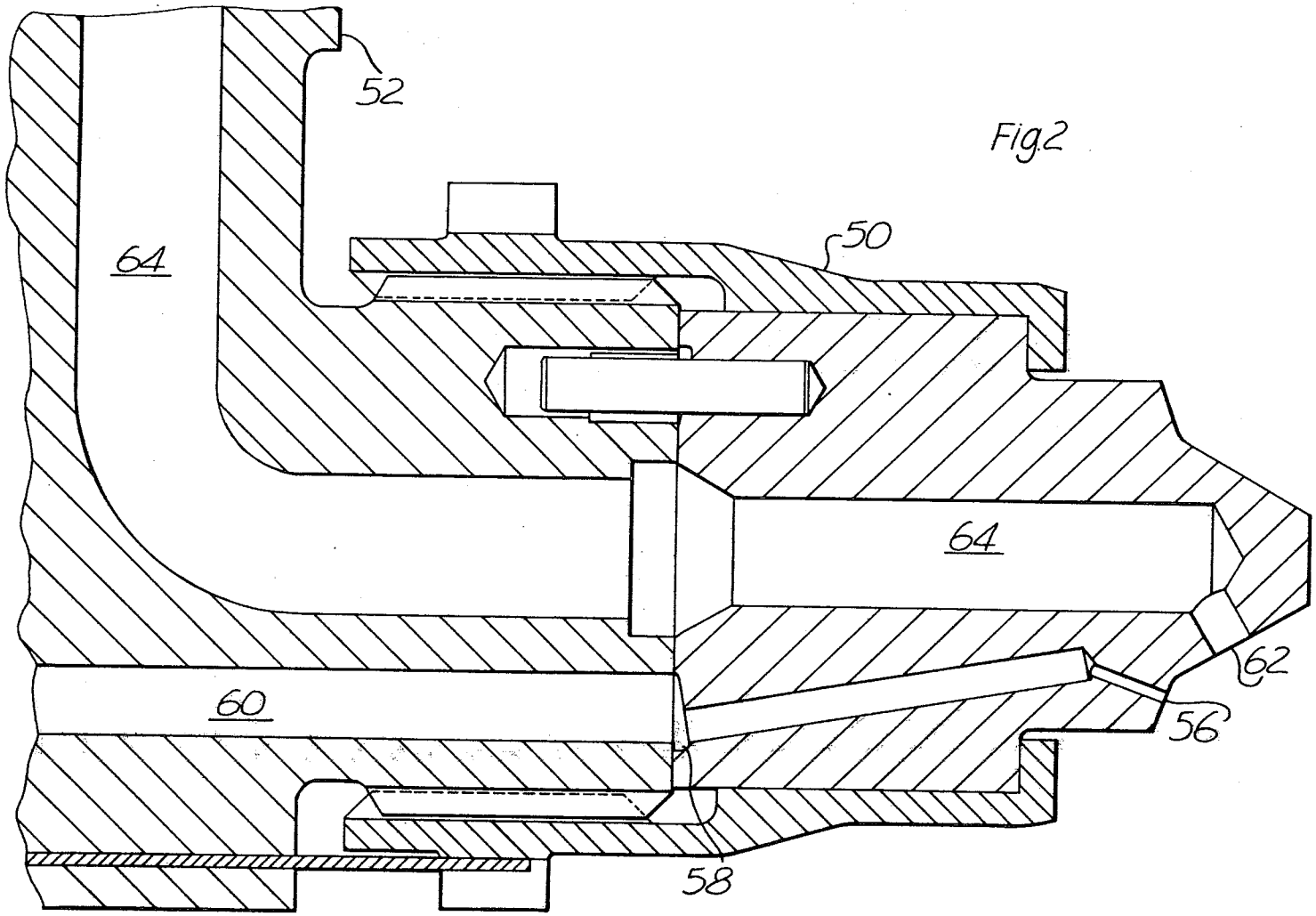

The present invention will now be more particularly described, with reference to the accompanying drawings in which:

FIG. 1 shows a diagrammatic elevation of one form of combustion equipment according to the present invention, and FIG. 2 shows the burner of the combustion equipment disclosed in FIG. 1 in greater detail to a larger scale.

Referring to the figures of the drawing, the combustion equipment of a gas turbine engine (not shown) comprises a burner 10 and a combustion chamber 12 (only part of which is shown), the burner being of the general type disclosed in British patent specification No. 1,427,146.

The burner 10 comprises a burner tube 14 defining a first duct, the tube being mounted in an aperture 16 in the head 18 of the combustion chamber 12 and located internally of the tube 14 is a core 20 having radially extending vanes 22 defining axial passages 24. A deflector 26 is attached to the downstream end of the core 20, an annular opening 28 being formed between the deflector 26 and the downstream end of the tube 14 which is provided with an inwardly directed lip 30 and an annular convergent portion 32.

Five equi-spaced feed ducts 34 extend through the tube 14 and a shroud member 36 in order to feed a fuel/air mixture into the primary zone 38 of the combustion chamber 12.

A fuel nozzle 50 mounted on an arm 52 is positioned in the opening 54 defined by the shroud member 36. The fuel nozzle 50 has five fuel outlets 56, each one of which is connected to a manifold 58 supplied with fuel from fuel line 60. The angle at which fuel normally issues from the outlets 56 is as shown in FIG. 1 by the line A so that fuel is directed towards the wall of the tube 14. The fuel nozzle also has five compressed air outlets 62 which communicate with a compressed air feed duct 64 in the nozzle and the feed arm, the outlets 62 being axially aligned with fuel outlets 56. The outlets 62 are also axially aligned with the ducts 34 and the angle of the outlets 62 is more acute than the angle of the outlets 56 so that compressed air issuing from the outlets 62 will pass through the ducts 34. The compressed air feed duct is connected to a pressure bottle 70 via a valve 72 which has a control 74. The control 74 which can be manual or automatic operates in the engine start-up sequence to allow compressed air to be discharged from the outlets 62 and will close when the engine has reached a predetermined rotational speed. The pressure bottle 70 can be recharged either from the engine compressor or an external source via a valve 76.

In order to ensure that sufficient fuel/air mixture reaches the primary zone 38 during the start-up sequence, the compressed air supply is actuated and compressed air issues from the outlets 62 and impinges on the fuel issuing from the outlets 56. The fuel is thereby induced to flow, with the compressed air, into the ducts 34 and thence into the primary zone 38. When the engine has reached a predetermined rotational speed, the compressor air supply is terminated and the fuel flows into the burner tube 14 as indicated by the line referenced A. The operation of the combustion equipment after this point is not relevant and is substantially as described in the aforementioned British patent specification No. 1,427,146.

Any suitable number of ducts 34 and corresponding compressed air outlets 62 may be provided and more fuel outlets 56 than air outlets 62 may be provided.

The invention may be applied to other types of combustion equipment to that shown and the apparatus for providing the compressed air may also differ from that shown, e.g. air can be supplied from an auxiliary pump or a compressor driven independently of the engine.

I claim:

1. Combustion equipment for a gas turbine engine comprising:

a combustion chamber including a primary zone, a first duct extending into the primary zone, and a plurality of second ducts extending from said first duct into said primary zone; and a fuel nozzle comprising a plurality of fuel outlets arranged to direct fuel through said first duct and into said primary zone during normal operation of the gas turbine engine, there being at least as many fuel outlets as there are said plurality of second ducts, and fuel directing means arranged to impinge air onto fuel discharged from at least a number of said fuel outlets and to direct the same into a corresponding number of said plurality of second ducts to provide a fuel and air mixture through said second ducts for discharge into said primary zone of said combustion chamber.

2. Combustion equipment as claimed in claim 1 in which the fuel directing means comprises a supply of compressed air in communication with a number of air outlets in the fuel nozzle, the air outlets being aligned with corresponding fuel outlets and directed to impinge compressed air upon the fuel issuing from the fuel outlets and to direct the fuel into the said second ducts.

3. Combustion equipment as claimed in claim 2 in which the compressed air supply comprises a container containing air under pressure connected by control means to an air supply duct in the fuel burner.

4. Combustion equipment as claimed in claim 3 in which the compressed air container is rechargeable by a valve from the compressor of a gas turbine engine of which the combustion equipment forms a part.

5. Combustion equipment as claimed in claim 3 in which the control means is operable to allow compressed air to flow to the fuel burner from the compressed air container only during the start-up sequence of the gas turbine engine of which the combustion equipment forms a part and to close off the compressed air supply when the said gas turbine engine reaches a pre-determined rotational speed.

* * * * *